US005885524A

United States Patent [19]

Watanabe et al.

[11] Patent Number: 5,885,524

[45] Date of Patent: Mar. 23, 1999

[54] METHOD OF PRESERVING RUBBER PRODUCTS

[75] Inventors: Hideaki Watanabe; Takayuki Watanabe, both of Tokyo, Japan

[73] Assignee: Mitsubishi Gas Chemical Company, Inc., Tokyo, Japan

[21] Appl. No.: 716,607

[22] Filed: Sep. 19, 1996

[30] Foreign Application Priority Data

Feb. 8, 1996 [JP] Japan ..... 8-022695

[51] Int. Cl.[6] ..... B65D 81/26; B65B 29/00

[52] U.S. Cl. ..... 422/40; 206/204; 53/402

[58] Field of Search ..... 422/40; 206/204, 206/213.1; 53/402

[56] References Cited

U.S. PATENT DOCUMENTS 2,363,717 11/1944 Wolk ..... 422/40 X
3,973,071 8/1976 Fahey .
4,908,151 3/1990 Inoue et al. ..... 252/188.28
5,286,407 2/1994 Inoue et al. ..... 252/188.25
5,378,428 1/1995 Inoue et al. ..... 422/40 X
5,510,166 4/1996 Inoue et al. ..... 428/76

*Primary Examiner*—E. Leigh McKane
*Attorney, Agent, or Firm*—Sughrue, Mion, Zinn, Macpeak & Seas, PLLC

[57] ABSTRACT

The objects of the present invention are to provide a method for preventing the deterioration of rubber products on storage, and maintaining quality of the rubber products good. The method of the present invention is characterized in that the rubber products are sealed in a container having gas barrier properties from which an oxygen and moisture are substantially removed, and in the above method, is characterized in that the rubber products are sealed in a container having gas barrier properties, together with an oxygen absorbent which requires no moisture for absorbing an oxygen and a dehydrating agent, and further preferably, is characterized in that the oxygen absorbent comprises an unsaturated fatty acid compound and/or a chain hydrocarbon polymer having unsaturated group as main agents and an oxygen absorbing accelerator.

11 Claims, No Drawings

METHOD OF PRESERVING RUBBER PRODUCTS

BACKGROUND OF THE INVENTION

1. Field of the Invention

The present invention relates to a method of preserving rubber products. In detail, the present invention relates to a method of preserving rubber products which is characterized in that the rubber products are sealed in a container having gas barrier properties, together with an oxygen absorbent which requires no moisture for absorbing an oxygen and a dehydrating agent.

2. Description of the Related Art

An elastomeric plastic used for rubber products is, for example, a natural rubber and a synthetic rubber, such as a butadiene synthetic rubber, an olefin synthetic rubber, a polysulfide rubber, a fluororubber, an urethane rubber, a silicone rubber and an acrylic rubber, etc, and most of which are diene polymer. Since these diene polymer rubbers have a ultra conjugated bond in structure, a hydrogen in a methylene group adjacent to a double bond is highly reactive, and is easy to be oxidized, and rubber products using these rubbers are easy to be deteriorated while storage.

For example, in case that a rubber band is stood in air for several years, it is glued, and it is easy to cut and the surface of it turns to fishskin, and it turned not to be tolerant for use. Further, rubber products of a natural rubber series are easily decomposited by the operation of the microorganisms. This is because of a rubber decomposition enzyme secreted by microorganisms, such as a hydrolase and an oxygenase, etc, and there is a case that the secretion relates to a generation of a bad smell. Further, adhesion of a metabolized sticky substance by organisms (bacteria, etc.) can be a problem in appearance. As microorganisms are generally have high water demand, this influence causes a problem under circumstances of much moisture.

Further, in sealing products of an O-ring, etc., decreases elasticity or strength with progress of aging, and the sufficient sealing properties would not be obtained. In medical goods represented by a surgical glove, adherence properties to a hand decreases or it becomes easy to be torn with deterioration of elasticity caused by the aging. Further, in rubber products, such as rollers, materials of rubber-soled shoes, materials of cushion, sports goods and toys, the elasticity required is lost with aging of the rubber, and the original object could not be achieved.

In order to improve such aging properties of the rubber products, recently, several technique that anti-aging agents, anti-bacterial and anti-molding agent are added have been practiced. However, the aging of the rubber products are mainly caused by the oxidative effects, and amines, phenols, a peroxide decomposer are said to be adequate for an antioxidant, however, many of these anti-aging agents have susceptibility of discoloration and polluting properties, a problem of appearance properties decreasing has been pointed out. Further, in case of an anti-bacterial agent and an anti-mold agent, it is necessary to consider the safety by the toxicity.

Furthermore, the effects of these additives are not necessarily guaranteed to be stable over a long term. Even rubber products in which anti-aging agents, anti-bacterial agent and anti-mold agents are added, when they are put into severe circumstances of a high temperature and humidity even for a short time or they are stored even in the air at room temperature for a long time, there is a case that the rubber is oxidized, and the discoloration occurs or the physical properties decrease, and microorganisms germinate by the moisture, and the rubber was decomposed to become those which could not be used as rubber products.

For the purpose of preventing the deterioration of rubber products, even if moisture is removed by using a drying agent, such as a silica gel, etc, there are many cases that the physical properties decrease by an oxygen in the system, and the validity as merchandising products are extremely damaged. Therefore, although storage is tried by using a drying agent in combination with a deoxygenating agent, when deoxygenating agents in which conventional known deoxygenating agents, such as iron powder, sulfite, catechol, ascorbic acid are used as a main component are used, the oxygen absorption property decreases at inter course and the deoxygenation could not sufficiently performed, the decrease in physical properties of the rubber products occur, and could not necessarily preserve in good.

As mentioned above, the actual facts are that there has been no simple preservation method of rubber products until this time.

SUMMARY OF THE INVENTION

The objects of the present invention lie in by solving the above problems and providing a method of preserving of rubber products in which the deterioration of the rubber products in storage is prevented, and the quality of the rubber products are held in good.

The inventors of the present invention have found that in order to achieve the above objects by preventing deterioration of the rubber products, it is insufficient in the atmosphere that either one of an oxygen or moisture in the storage atmosphere is removed, but it is necessary that both an oxygen and moisture are interrupted simultaneously, and have reached to the present invention.

That is, the method of preserving of rubber products of the present invention is a method which is characterized in that the rubber products are sealed in a gas barrier container from which an oxygen and moisture are substantially removed.

Further, the method is characterized in that in the above method, the rubber products are sealed with an oxygen absorbent that requires no moisture for absorption of an oxygen and a dehydrating agent in a gas barrier container. Further, in the above method, preferably, the oxygen absorbent contains an acidic gas absorbent.

Furthermore, the method is preferably characterized in that the oxygen absorbent contains an unsaturated fatty acid compound and/or a chain hydrocarbon polymer having unsaturated group as the main component, and an oxygen absorbing accelerator.

In the above method of the present invention, the state that oxygen is substantially removed means that the concentration of oxygen is 5% or less, preferably 1% or less, more preferably 0.1% or less. Further, the state that moisture is substantially removed means that a relative humidity is 10% or less, preferably 5% or less, more preferably 1% or less.

In the method of the present invention, the atmosphere in which either of an oxygen or moisture is removed is insufficient, it is essential that a state that substantially no oxygen and low humidity condition is made up simultaneously in the system. In case that either of the oxygen concentration or the relative humidity is high and exceeds the range described above, the oxygenation proceeds while the storage, and decoloration occurs, elasticity decreases, it becomes glued, hardened or cracked, and the rubber products could not be maintained in good for a long term and it could not satisfy the demanded properties.

The method of the present invention can be applied without limitation particularly to products used of rubber to which the present invention can be applied and in which the objects of the present invention can be achieved. A tire, a tube, a hose, a belt, a packing, an O-ring, a gasket, a roller, an insulating coating material, a rubber-soled material, a cushion material, an insulation, a caulking material, an adhesive, a paint, a stationary, a medical goods, a sports-article and a toy are listed for example as the rubber products, and particularly, the present invention is preferable to a packing, an O-ring, a gasket and a medical supply, such as a surgical glove or a contraceptive.

DESCRIPTION OF THE PREFERRED EMBODIMENTS

In the present invention, the above mentioned atmosphere can be made by sealing rubber products together with an oxygen absorbent which requires no moisture and a dehydrating agent in a gas barrier container, and further preferably, by containing an acidic gas absorbent. In case that the acidic gas exists, concurrent use of the acidic gas absorbent is effective, since change of properties of the rubber is further accelerated.

The oxygen absorbent used in the present invention is not particularly limited, as long as it requires no moisture and an oxygen absorbent containing an unsaturated organic compound, such as an unsaturated fatty acid compound or a chain hydrocarbon polymer having unsaturated group, and a thermoplastic polymer, such as a polyamide or polyolefin, etc., as a main component and an oxygen absorbent accelerator, such as a transit metal salt, etc., are exemplified, however, an oxygen absorbent containing an unsaturated fatty acid compound and/or a chain hydrocarbon polymer having unsaturated group as a main component and an oxygen absorbent accelerator is preferable.

The unsaturated fatty acid compound used as the oxygen absorbent is an unsaturated fatty acid having 10 or more carbon atoms and having double bond between carbons, or the salts or esters of the unsaturated fatty acid. The unsaturated fatty acid and the salts or esters may has a substituted group, for example, hydroxyl group, etc., a formyl group. Further, the unsaturated fatty acid compound may be used alone, or it may be used in combination more than two kind.

As an example of the unsaturated fatty acid compound, unsaturated fatty acid, such as, an oleic acid, linoleic acid, linolenic acid, arachidonic acid, parinalic acid, dimer acid, or ricinolic acid, etc.; and fats, esters, metal salts containing these esters are exemplified.

Further, as an unsaturated fatty acid, a fatty acid obtained from plant oil, animal oil, i.e., linseed oil fatty acid, soybean oil fatty acid, tung oil fatty acid, rice-bran oil fatty acid, sesame oil fatty acid, cottonseed oil fatty acid, rapeseed oil fatty acid, tall oil fatty acid, etc., are also used.

Further, the chain hydrocarbon polymer having unsaturated group is a polymer and the derivatives having 10 or more carbon atoms, and having more than one double bond between carbons. The derivatives may contain, for example, a hydroxyl group, an amino group, a formyl group, a carboxyl group, etc., as a substituent.

As examples of the chain hydrocarbon polymer having unsaturated group, oligomers or polymers of butadiene, isoprene, 1.3-pentadiene, etc. can be listed. The chain hydrocarbon polymer may be used alone, or it may be used in combination with more than two kinds.

As the oxygen absorbing accelerator, metal salts which can accelerate autoxidation of an organic compound, or a radical initiator can be exemplified. As the metal salts, a transient metal salt of Cu, Fe, Co, Ni, Cr, Mn, etc., are preferable, and as the transient metal salts, for example, unsaturated fatty acid transient metal salt are preferably used.

As the carrier substance, a paper or a synthetic paper made from a natural pulp or a synthetic pulp, a silica gel, an alumina, an activated carbon, a zeolite, a pearlite, an activated clay, etc., are exemplified. Particularly, when the main agent is a liquid substance, an adsorptive substance is preferably used as a carrier substance. Further, it is a practical method for use that a substance which is chosen as a dehydrating agent is selected as a carrier substance, and that dehydrating ability is given to the carrier substance.

As the acidic gas absorbent used in the present invention, a substance which is able to absorb or adsorb an acidic substance being produced by a reaction of the main component, or being introduced into the storage atmosphere may be used, for example, an oxide, a hydroxide, a carbonate, an organic acid salt or an organic amine of an alkali metal or an alkaline earth metal may be used. These acidic gas absorbents may be used alone, or may be used in admixture with more than two kinds of it. Further, it is also possible that the basic substance is selected as a carrier substance or a dehydrating agent, so as to function as it, in this case, addition of a separate acidic gas absorbent is not necessary.

The ratio of components constituting the oxygen absorbent is from 0.01 to 40 parts by weight of an oxidation accelerating agent and from 1 to 1,000 parts by weight of a carrier substance per 100 parts by weight of a main component. Further, the acidic gas absorbent may be used from 1 to 1000 parts by weight depending upon the necessity.

The oxygen absorbent, when it is a liquid substance, is preferably supported on a carrier substance. The above components are mixed, and the oxygen absorbent is used in the form of granules, a tablet or a sheet, etc. Usually, these oxygen absorbents are used as a package which is coated by a known breathing wrapping material in which a paper or a nonwoven fabric is used as a basic material. The form of the package is not necessarily limited, and can be in a form of a packet, sheet or blister package, depending upon the purpose of it.

Further, in case of the rubber products which is easily damaged by dusts, as the dustproof countermeasure, it is possible to additionally cover the above mentioned package by a dust free lapping material which is an oxygen and moisture can permeate freely. Of course, in case that the package itself has dustproof properties or the lapping materials are taken a dustproof measure, the further lapping by a dustfree wrapping material is not necessary.

As the dehydrating agent for use in the present invention contains, for example, a paper or synthetic paper comprising a natural pulp or a synthetic pulp, a silica gel, an alumina, an activated carbon, a zeolite, a pearlite, an activated clay, a quick lime, a barium oxide, a calcium chloride, a barium bromide, a calcium sulfate, a magnesium chloride, a magnesium oxide, a magnesium sulfate, an aluminum sulfate, a sodium sulfate, a sodium carbonate, a potassium carbonate, a zinc chloride, etc. These dehydrating agent may be used alone or in admixture with more than two kinds of it.

The dehydrating agent may be used in admixture with the above described oxygen absorbents, or in the form of an individual package.

As the amount of the oxygen absorbent and dehydrating agent, the amount of the oxygen absorbent is at least one which the oxygen existing in the space volume of a sealed package can be absorbed, and is preferably in the range from 1.1 to 10 times of the amounts, and the amount of the dehydrating agent is at least one which the moisture existing in the space volume of the sealed package can be absorbed, and is preferably in the range from 1.1 to 500 times of the amounts, and the amount is precisely selected depending upon the barrier properties of the gas barrier container.

The gas barrier container used in the present invention is selected depending upon the purpose, for example, gas barrier containers, such as a plastic container, a film package, a metal container and a glass container, etc. Hereinafter, there is a case that a gas barrier container is simply called as a container.

The gas barrier properties of the gas barrier container is preferably 10 ml/$m^2$·Day·atm or less of the oxygen permeability at 25° C., 60% RH, and 1 g/$m^2$·Day or less of the water vapour transmission at 40° C., 90% RH. It is advantageous in cost that the barrier properties is selected to avoid excess properties depending upon the purpose.

Further, when the rubber products are sealed in the container, inner of the container may be replaced by a dry nitrogen gas, and the gas replacement causes the decrease of the amount of use of the oxygen absorbent and dehydrating agent, particularly the oxygen absorbent.

EXAMPLES

Hereinafter, the examples of the present invention are showed, and explained in more detail. The present invention should not be construed as being limited to these Examples.

Example 1

The preparation of a gas absorbent lapping material:

Soybean oil was selected as the main component, an unsaturated organic compound, and cobalt naphthenate (Co content of 8% by weight) as the oxygen absorbent was selected, and 350 parts by weight of Zeolite were added into the mixture of 100 parts by weight of the soybean oil and 20 parts by weight of the cobalt naphthenate and mixed using a blender, then stood at 25° C. for 10 minutes to obtain powder having flowability. The obtained 5 g of powder and 2.5 g of quick lime were mixed and charged into a paper packet (size: 5 cm×7.5 cm) which was laminated by a polyethylene film having pores towards inner surface to make a gas absorbent package (hereinafter simply called as a gas absorbent).

Storage test of a rubber band:

A rubber band (trade mark O-band #170, manufactured by Kyowa Co., Ltd.) prepared as a representative of the rubber products and the gas absorbent prepared above were sealed with 500 ml of air (25° C., 60% RH) in a package of an aluminum foil laminated material (size: 220 mm×300 mm, hereinafter called A1 package), and the opening part was sealed by heat sealing. The sealed A1 package was stored under the atmosphere of 40° C., 95% RH for 4 weeks.

4 Weeks later, the concentrations of the oxygen and the moisture in the A1 package in which the rubber band was stored were measured by using a gas chromatography, and confirmed that the inside of the storage system was maintained under the atmosphere that an oxygen and moisture were substantially removed. Then, the rubber band was removed from the A1 package, and the appearance was observed and as well as the measurement of an extension of the rubber band was conducted. For the measurement of an extension, a tensile strength tester (Tohsoku Seimitsu Kogyo Co., Ltd.:STM-20) was used, and measured under the atmosphere of 25° C., 50% RH.

In the appearance of the rubber band stored for 4 weeks, the change of surface condition and the color change were not seen at all, comparing with the condition before of the storage, and extension value was almost the same as that of before storage. The result is shown in Table 1.

Examples 2–4

In the Examples 2–4, the gas absorbent was prepared using the same procedures as in Example 1, except that the combination of the main component of the gas absorbent and the oxygen absorbent accelerator were changed as follows.

| Main Component (100 parts by weight) | Oxygen absorbent accelerator (20 parts by weight) |
|---|---|
| Example 1 Soybeen oil | Cobalt naphtanate |
| Example 2 Tall oil fatty acid | Cobalt naphtanate |
| Example 3 Soybean oil | Cobalt tall oil fatty acid[Note2)] |
| Example 4 Soybean oil + Liquid Polyisoprene[Note1)] | Cobalt naphtanate |

[Note1)]Mixture of Soybean oil: Liquid Polyisoprene (manufactured by Nihon Synthetic Rubber Co., Ltd., DynakrinR113) = 6:4.
[Note2)]Cobalt tall oil fatty acid; Co content of 6% by weight Using the above gas absorbents which were different combination of the main component and an oxygen absorbent accelerator, storage tests of the rubber bands were conducted as in Example 1. The results of the storage tests of Examples 2 to 4 were shown in Table 1.

TABLE 1

| | Example 1 | Example 2 | Example 3 | Example 4 |
|---|---|---|---|---|
| Organic Compound of the main | soybean oil | tall oil fatty acid | soybean oil | soybean oil/Liquid isoprene |
| Oxygen absorbent accelerator | Co naphthanate | Co naphthanate | tall oil fatty acid Co naphthanate | Co. naphthanate |
| Oxygen conc. (%) | 0.04 | 0.03 | 0.03 | 0.03 |
| Humidity (% RH) in the Package after 4 weeks | <1 | <1 | <1 | <1 |
| Result of the storage of the rubber band | | | | |
| Observation | No color change No odor | No color change No odor | No color change No odor | No color change No odor |
| Extension (%) | 350 | 330 | 320 | 340 |
| Tensile Strength (Kgf) | 14.0 | 12.0 | 10.0 | 13.0 |

Note) The rubber band before storage: Extension; 350%, Tensile Strength; 16.0 kgf

Comparative Examples 1–4

As the comparative example of the rubber band storage, using the rubber band prepared in Example 1, when stored and sealed in the A1 package, in the comparative Example 1, without containing the gas absorbent, only the rubber band was sealed together with 500 ml of air, further in the comparative Example 2, after the air inside the package was replaced with a dried nitrogen gas and then sealed with the 500 ml of nitrogen gas, in the comparative Example 3, one of Fuji silica gel A type (Manufactured by Fuji Davidson Chemical Co., Ltd., 10 g) was contained and sealed together with the 500 ml of air, further in the comparative Example 4, one of the iron deoxygenating agent (Manufactured by Mitsubishi Gas Chemical Co., Inc., Ageless Z-100PT) was contained and sealed together with the 500 ml of air, as in the previous Example stored for 4 weeks under an atmosphere of 40° C. and 95% RH.

As to four rubber bands stored for 4 weeks, the oxygen concentration and moisture in the sealed A1 package were measured, then the rubber band were removed from the sealed A1 package, and the appearance was observed, as well as the measurement of the extension of the rubber band was conducted. The results of storage tests of the rubber bands of Comparative Examples 1–4 are shown in Table 2.

TABLE 2

| | Example 1 | Com. Example 1 | Com. Example 2 | Com. Example 3 | Com. Example 4 |
|---|---|---|---|---|---|
| Oxygen conc. (%) | 0.04 | 21 | 0.05 | 21 | 0.05 |
| Humidity (% RH) in the Package after 4 weeks | <1 | 80 | 30 | 10 | 80 |
| Result of the storage of the rubber band | | | | | |
| Observation | No color change No oder | Extreme color change odor | A little color change A little odor | Extreme color change odor | Slight color change No odor |
| Extension (%) | 350 | 130 | 200 | 160 | 280 |
| Tensile Strength (Kgf) | 14.0 | 1.5 | 2.0 | 1.5 | 6.0 |

Note) The rubber band before storage: Extension; 350%, Tensile Strength; 16.0 kgf In the Examples 1–4, the rubber bands stored for 4 weeks, the appearance and the extension were almost the same as before storage. Contrarily to this, Comparative Examples 1–4 were as shown in Table 2, bad smell by the aging of the rubber recognized, and in the appearance the change of the color was recognized, further, the decrease of the extension and the tensile strength were extreme, and deterioration was recognized in flexibility.

Example 5

O-ring (Manufactured by Morisei, Material of Viton, G-70, 3 mm diameter, 4D) and the gas absorbent prepared in Example 1 were sealed in the A1 package together with 500 ml. of air (25° C., 60% RH), and the A1 package was sealed by heat sealing. The A1 package was stored under the atmosphere of 40° C., 95% RH for 1 year.

The A1 package stored for 1 year, the concentration of the oxygen and moisture were measured by a gas chromatography, and confirmed that the inside of the storage system was maintained under the atmosphere that an oxygen and moisture were substantially removed. Then, the O-ring was removed from the A1 package, and the appearance was observed, and change of the surface condition and the gloss was not observed at all, comparing with that before of the storage, and the tensile strength of the O-ring was measured and the value was substantially the same as that of before storage. For the measurement of an tensile strength, a tensile strength tester (Shimazu Co., Ltd.: AG5000) was used. The result was shown in Table 3.

TABLE 3

| | Example 5 | Com. Example 5 | Com. Example 6 | Com. Example 7 |
|---|---|---|---|---|
| Oxygen conc. (5) | 0.04 | 21 | 21 | 0.04 |
| Humidity (% RH) in the Package after 1 | <1 | 80 | 10 | 80 |
| Result of the storage of the O-ring | | | | |
| Observation | No color change | Decrease in a gloss | A little decrease in a gloss | Slight decrease in a gloss |
| Tensile Strength ($Kg/cm^2$) | 150 | 80 | 100 | 110 |

Note) The O-ring band before storage: Tensile Strength: 160 $kg/cm^2$

Comparative Examples 5–7

As the comparative examples of the O-ring storage, when the O-ring prepared in Example 5, was sealed and stored in the A1 package, in the comparative Example 5, without containing the gas absorbent, only the rubber band was sealed together with 500 ml of air, further in the comparative Example 6, one of FuJi silica gel A type (Manufactured by Fuji Davidson Chemical Co., Ltd., 10 g) was contained and sealed together with the 500 ml of air, further in the comparative Example 7, one of the iron powder type deoxygenating agent (Manufactured by Mitsubishi Gas Chemical Co., Inc., Ageless Z-100PT) was contained and sealed together with the 500 ml of air, as in Example 5 stored for 1 year under an atmosphere of 40° C. and 95% RH, respectively.

As to four O-rings of Comparative Examples 5–7 stored for 1 year, the oxygen concentration and moisture in the sealed A1 package were measured respectively, then, the O-rings were removed from the sealed A1 package, and the appearance was inspected, as well as the measurements of the tensile strength of the O-rings were conducted. The results of storage tests of the rubber bands of Comparative Examples 1–4 are shown in Table 3.

As shown in the Table 3, in the O-rings of the comparative examples 5–7 stored for 1 year, the decrease of a gloss of the surface in appearance was recognized, further, the decrease of the tensile strength was recognized. Contrarily to this, in Examples 5, there was no change of surface condition and a gloss of the O-ring, and the tensile strength was not changed, thus, the excellent effects of the maintaining the quality of the method of the present invention is clear.

According to the method of the present invention, by preserving rubber products sealed in a container having gas barrier properties from which an oxygen and moisture are substantially removed, the deterioration of the rubber is prevented to be able to maintain the quality good, for example, there is no color changing, gluing, curing, cutting and the decrease of elasticity and strength. Further, According to the present invention, by sealing rubber products in a container having gas barrier properties, together with an oxygen absorbent and dehydrating agent which require no moisture, by only using the extremely simple method, the rubber can be stored in good condition.

We claim:

1. A method of preserving a rubber product comprising: sealing the rubber product in a container having an oxygen permeability of 10 ml/$m^2$·day·atm or less at 25° C. and 60% RH and a water vapor permeability of 1 g/$m^2$·day or less at 40° C. and 90% RH together with an oxygen absorbent which requires no moisture for absorbing oxygen and a dehydrating agent, and substantially removing oxygen and moisture from the container so as to provide a relative humidity of 10% and less.

2. The method of preserving a rubber product described in claim 1, wherein the oxygen absorbent comprises an acidic gas absorbent.

3. The method of preserving a rubber product described in claim 2, wherein the rubber product is a packing, an O-ring or a gasket.

4. The method of preserving a rubber product described in claim 2, wherein the rubber product is a medical rubber product.

5. The method of preserving a rubber product described in claim 1, wherein the oxygen absorbent comprises an unsaturated fatty acid compound and/or a chain hydrocarbon polymer having an unsaturated group and an oxygen absorbing accelerator.

6. The method of a preserving rubber product described in claim 5, wherein the rubber product is a packing, an O-ring or a gasket.

7. The method of preserving a rubber product described in claim 5, wherein the rubber product is a medical rubber product.

8. The method of preserving a rubber product described in claim 1, wherein the rubber product is a packing, an O-ring or a gasket.

9. The method of preserving a rubber product described in claim 1, wherein the rubber product is a medical rubber product.

10. The method of preserving a rubber product according to claim 1, wherein the relative humidity is 5% or less.

11. The method of preserving a rubber product according to claim 1, wherein the relative humidity is 1% or less.

* * * * *